US005803239A

United States Patent [19]

Bray et al.

[11] Patent Number: 5,803,239

[45] Date of Patent: Sep. 8, 1998

[54] POTENTIOMETER WITH CLEANING INLET

[75] Inventors: David William Bray; Paul Ronald Petro, both of Rock Springs, Wyo.

[73] Assignee: David W. Bray, Rock Springs, Wyo.

[21] Appl. No.: 670,881

[22] Filed: Jun. 28, 1996

[51] Int. Cl.[6] ..... H01H 3/08

[52] U.S. Cl. ..... 200/336; 200/242; 200/570; 200/571

[58] Field of Search ..... 200/336, 570, 200/564, 253, 242, 567, 571, 307.1; 338/67, 75

[56] References Cited

U.S. PATENT DOCUMENTS

| | | | |
|---|---|---|---|
| 1,497,688 | 6/1924 | Kunkle | 200/571 |
| 2,045,417 | 6/1936 | Siegel | 200/571 |
| 2,786,904 | 3/1957 | Hewes et al. | 200/571 |
| 4,000,382 | 12/1976 | Kolb | 200/336 |
| 5,192,939 | 3/1993 | Kossow et al. | 338/75 |
| 5,563,387 | 10/1996 | Myers et al. | 200/333 |

*Primary Examiner*—David J. Walczak

*Attorney, Agent, or Firm*—Trask, Britt & Rossa

[57] ABSTRACT

A rotary switch is mounted in a housing having a hollow interior. The rotary switch includes a shaft, which rotatably extends through a male threaded mounting. The rotatable shaft defines a bore which extends from an inlet defined on an exterior surface of the shaft, through a length of the shaft. The bore communicates with an outlet defined in the exterior surface of the shaft. The outlet is disposed within the hollow interior of the housing, while the inlet of the bore is positioned external to the housing. The bore defines a passageway within the body of the shaft through which a cleaning fluid may pass. The inlet of the bore is covered by a knob which is removably secured to the shaft. A first contact is connected to the rotatable shaft. A second contact is disposed within the interior of the housing for contacting the first contact. The first contact is also disposed within the interior of the housing. The bore may be used in cleaning the contacts positioned within the interior of the housing. To clean the first contact and the second contact, the knob is removed and a tube, connected to a pressurized canister is inserted into the bore. Fluid from the canister passes through the bore and over the first contact and the second contact thereby cleaning them.

16 Claims, 3 Drawing Sheets

POTENTIOMETER WITH CLEANING INLET

BACKGROUND OF THE INVENTION

1. Field of the Invention

The invention relates to rotary switches. More particularly, the invention is directed to rotary switches adapted for facilitating the cleaning thereof to improve efficiency.

2. State of the Art

The volume and other sound characteristics of electronic devices are often controlled by rotary switches. Conventional examples of electronic devices which include such rotary switches are guitars, guitar amplifiers and mixers. Indeed, large mixers may include several dozen such rotary switches.

Rotary switches are typically secured within the cabinets or housings of electronic equipment. A front panel of the equipment cabinet oftentimes includes an opening through which the rotatable shaft of the switch is inserted. A knob, connected to the rotatable shaft, is accessible to a user outside of the cabinet. The user turns the knob to control the rotary switch. In typical constructions, the contacts of the switch are on the inside of the equipment cabinet, while the knob is on the outside of the cabinet.

The contacts for rotary switches are typically contained in a cavity defined by a switch cover which defines an access opening. In use, dirt and other contaminants tend to collect on the electrical connections of the switch, thereby impairing the operation of the switch. Regular cleaning of the contacts is necessary in order to ensure proper performance of the switch. A common technique for cleaning the contacts of rotary switches is to spray them with contact cleaning fluid, such as conventional cleaning solutions or air under pressure from a canister. The fluid is introduced into the switch cavity through the access opening in the switch cover. Given that the switches are normally mounted in the cabinet of the equipment, ordinarily, the user must remove the front panel from the equipment cabinet to provide a way to reach the access opening in the switch cover. The process of removing the front panel of the cabinet in order to clean the switch contacts has proven to be a time consuming exercise.

At least one attempt has been made to address the problem of cleaning the contacts of a potentiometer secured in an equipment housing. U.S. Pat. No. 5,192,939 to Kossow et al. describes a cleaning device that includes a hollow housing having a cylindrical construction. The housing has an opening at one end which has internal threads designed to form a threaded, fluid-tight union with the external threads of a cylinder of a potentiometer. The Kossow cleaning process appears to involve introducing a pressurized fluid flow through an annular space between the rotatable shaft and a cylinder. See U.S. Pat. No. 5,192,939, col. 3, lines 2–4. In those potentiometer constructions wherein the shift is pressure or spring loaded in the cylinder, the annular space between the rotatable shaft and the cylinder is generally not accessible. A collar of the shaft is typically biassed against the cylinder by the loading thereby closing off access to the annular space between the shaft and the cylinder. The Kossow approach requires the user to introduce cleaning fluid under adequate pressure to overcome the pressure loading on the shaft so as to displace the shaft relative to the cylinder sufficiently to provide access to the annular space between the shaft and the cylinder. The Kossow approach is believed to be inefficient because a considerable amount of pressure is required to separate the shaft from the cylinder in order to define a flow path to the cavity of the rotary switch.

Further, it is believed that a substantial amount of the fluid does not make it to the contacts.

There remains, therefore, a need for a time efficient way in which to clean contacts of a rotatory switch.

SUMMARY OF THE INVENTION

A rotary switch adapted for ease in cleaning the electrical contacts of the switch is disclosed. The switch includes a housing which defines a hollow interior space or cavity. A shaft is rotatably mounted in the housing whereby a first portion of the shaft is positioned outside of the housing while a second portion of the shaft is disposed within the interior space. The shaft defines a bore which extends through the body of the shaft and along a length of the shaft. The bore communicates with an inlet which is defined on the surface of the first portion of the shaft, i.e., the inlet is positioned outside of the housing. The bore also communicates with an outlet which is positioned on the exterior surface of the second portion of the shaft, i.e., the outlet is located within the interior space of the housing. The bore, in association with its inlet and outlet, defines a passageway which intercommunicates the environment with the interior of the housing through the body of the shaft.

In some constructions, the bore is linear in configuration with the inlet being located on a first end of the shaft and the outlet being located on a second end of the shaft. In other constructions, the inlet and outlet are located at other locations on the exterior surface of the shaft, e.g., along the length of the shaft. In one embodiment, the bore is linear in configuration. In those embodiments wherein the inlet is positioned on the first end and the outlet is located on the second end, and the bore is linear; the bore, in association with the inlet and the outlet, provides a direct linear passageway from the environment to the interior of the rotary switch housing.

The bore inlet is covered by a knob which is secured to the shaft. In one construction, the knob is manually detachable from the shaft. When the knob is in place on the shaft, the knob may cover the inlet thereby precluding the entry of dirt or other debris into the bore. When the knob is removed, the inlet and bore may become readily accessible to the user.

A first electrical contact is disposed within the interior space of the switch housing and is secured to the shaft. A second electrical contact is disposed within the interior space of the switch housing and is positioned to contact the first electrical contact upon a rotation of the shaft.

The bore, in association with the inlet and the outlet, defines a passageway whereby the user may introduce a flow of cleaning fluid directly into the interior space of the switch housing and to the first contact and second contact.

The invention further includes a kit including a source of pressurized cleaning fluid, a hollow elongate tube connectable to the source of pressurized cleaning fluid and dimensioned to be received within the inlet and the bore, and the rotary switch described above.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE PREFERRED EMBODIMENTS

Figure 1:
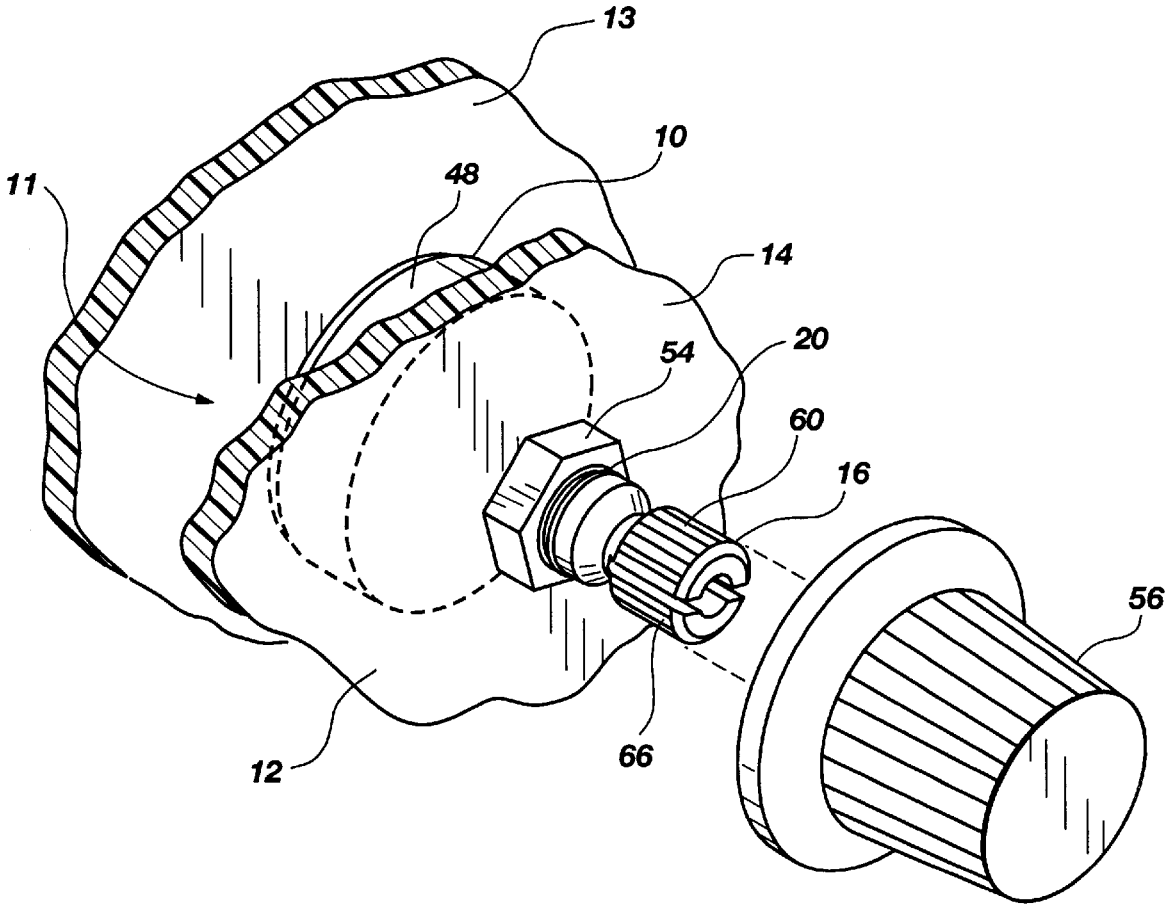
FIG. 1 illustrates a perspective view of the rotary switch of the invention mounted in a cabinet shown in section.
Figure 2:
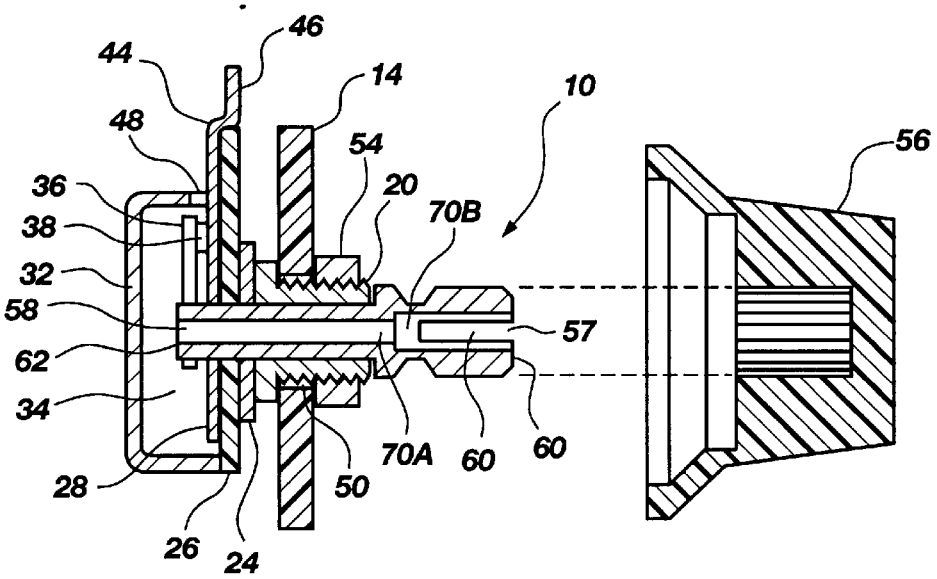
FIG. 2 shows a cross-sectional side view of a rotatory switch according to the present invention.

Referring to FIGS. 1 and 2, a rotary switch, shown as a potentiometer 10, is mounted in the interior 11 of a cabinet e.g. a guitar, mixer, or guitar amplifier 12 having a surface support (or front panel) 14 and a rear panel 13. Potentiometer 10 includes a rotatable shaft 16, which extends through a channel defined in a threaded shaft 20 having an expanded end 24. Rotatable shaft 16 also extends through an insulating base or circuit board 26. A housing 32 joins to the outer edge of circuit board 26 and to expanded end 24 of threaded shaft 20. A stationary contact 28 (also called a resistive element or slide wire) is connected to circuit board 26. A moveable contact 36 including a head 38 is connected to rotatable shaft 16. Housing 32 defines a cavity 34 in which movable contact 36 (including head 38) and a portion of stationary contact 28 reside. In some embodiments, contact points 44 are joined to circuit board 26. Contacts 46 are joined to contact points 44. An aperture 48 may be formed between cover 32 and circuit board 26.

In assembly, rotatable shaft 16 and threaded shaft 20 are inserted through an aperture 50 in front panel 14. A nut 54 is threaded around threaded shaft 20 securing potentiometer 10 to front panel 14. A knob 56 is then placed on the end of rotatable shaft 16.

As rotatable shaft 16 is rotated, head 38 of moveable contact 36 moves to a different position on stationary contact 28 altering the resistance of potentiometer 10. The difference in resistance is manifested at contacts 46.

Rotatable shaft 16 includes a first end 60 and a second end 62. In normal operation, knob 56 covers first end 60. Knob 56 is attached to shaft 16 to be manually detachable from the shaft 16. Depending on the knob chosen, the portion of rotatable shaft 16 covered by knob 56 may have a greater diameter than the portion of rotatable shaft 16 that extends inside threaded shaft 20. Further, the portion of rotatable shaft 16 covered by knob 56 may have splines such as spline 66 to facilitate the securement of the knob 56 on shaft 16.

Rotatable shaft 16 defines a bore 70 that extends from an inlet 57 defined in first end 60 to an outlet 58 located on second end 62. Bore 70 may be cylindrical in configuration. In a preferred embodiment, bore 70 comprises a first section 70A and a second section 70B. Section 70B may have a diameter which is larger than the diameter of section 70A to allow a tube 74 to be inserted into section 70B, but not section 70A.

Cover 32 and support surface 14 prevent most contaminants from entering cavity 34. Nevertheless, some contaminants do find their way into cavity 34 and onto stationary contact 28 and head 38 of movable contact 36. Such contaminants include dust and other air born particles, and food and drinks. The contaminants impair the operation of the potentiometer by causing the resistance provided by the components of the potentiometer 10 to be somewhat inaccurate and uncontrollable.

Figure 3:
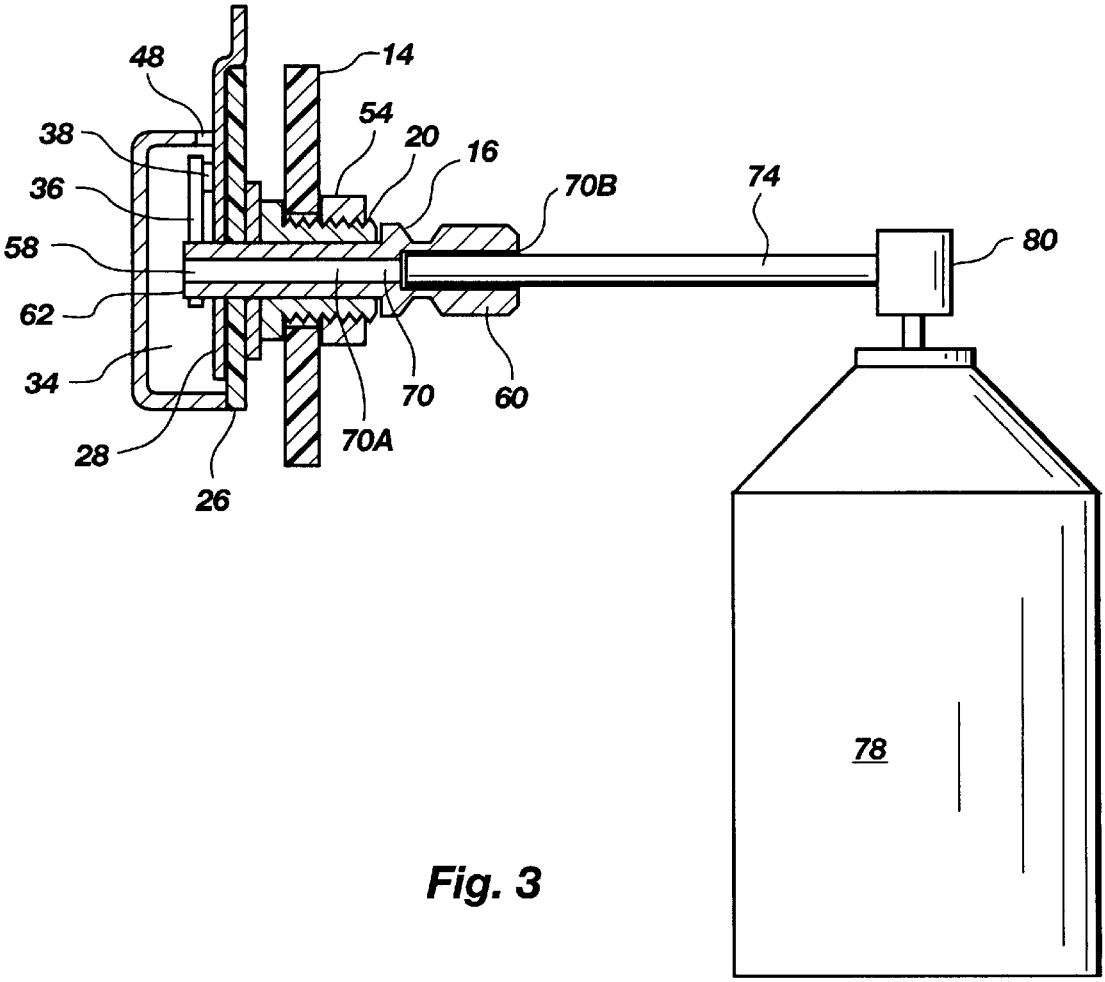
FIG. 3 shows a cross-sectional side view of a rotatory switch of FIG. 2 with the tube of a spray canister inserted into an orifice of a rotatable shaft of the rotatory switch.

Referring to FIG. 3, to clean stationary contact 28 and movable contact 36 (including head 38), knob 56 is removed from rotatable shaft 16. A hollow tube 74 connected to a pressurized canister 78, containing a cleaning fluid, is inserted into section 70A of bore 70. The user presses on button 80 releasing a stream of fluid through tube 74 into bore 70 and cavity 34. The fluid passes over stationary contact 28 and movable contact 36 (including head 38) and exits through aperture 48. As used herein, a "fluid" may be a liquid or a gas, such as air.

Accordingly, it is not necessary to remove support surface 14 to clean stationary contact 28 and movable contact 36 (including head 38). Further, the procedure is simple and efficient.

It is preferred but not required that bore 70 be cylindrical.

As used in the claims, the term "connect," "connectable," or "connected to" are not necessarily limited to a direct connection.

Figure 4:
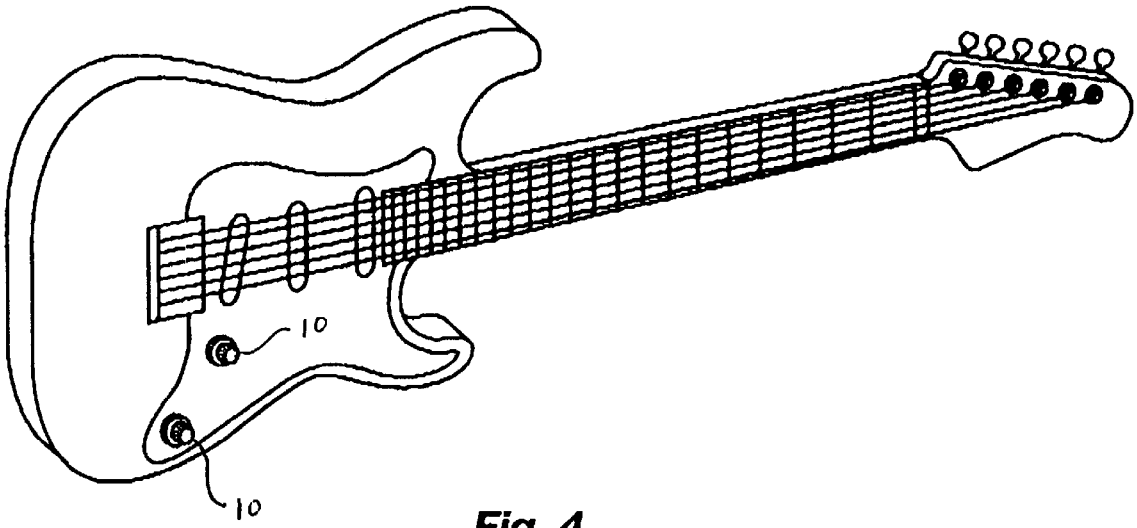
FIG. 4 is a perspective view of a guitar showing two rotary switches of the invention mounted therein.
Figure 5:
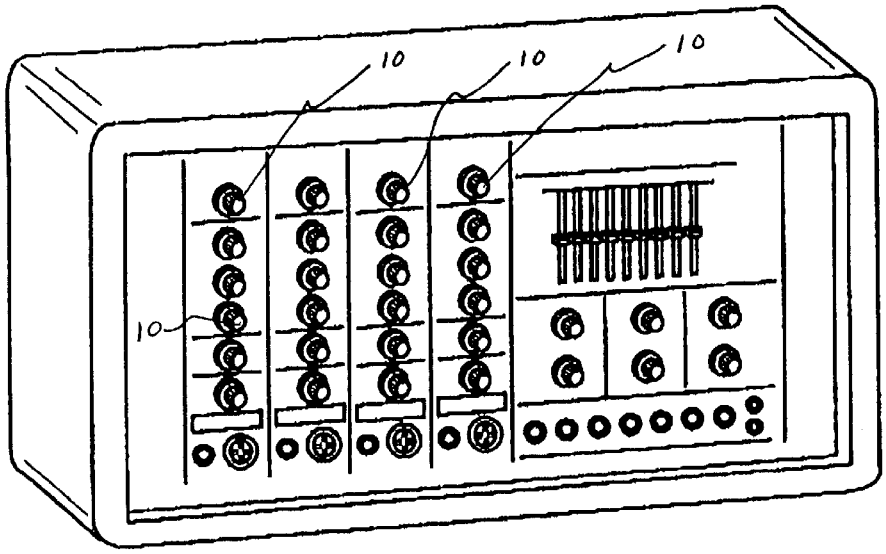
FIG. 5 is a perspective view of a mixer showing a number of rotary switches of the invention mounted therein.

FIGS. 4 and 5 illustrate the positioning of rotary switches of the invention in a guitar and a mixer.

Having thus described in detail preferred embodiments of the present invention, it is to be understood that the invention defined by the appended claims is not to be limited by particular details set forth in the above description as many apparent variations thereof are possible without departing from the spirit or scope thereof.

What is claimed is:

1. A rotary switch comprising:

a housing having a hollow interior;

a shaft rotatably mounted in said housing, said shaft having an exterior surface and defining a bore which extends through a length of said shaft, said bore communicating with an inlet, defined in the exterior surface of said shaft, said bore further communicating with an outlet defined in said exterior surface of said shaft, said inlet being positioned externally of said housing, said outlet being positioned within said interior of said housing, said bore establishing a fluid communication between the environment and said interior;

a first contact connected to said shaft, said first contact being disposed within said interior; and a second contact, disposed within said interior, positioned to contact said first contact;

wherein said bore provides a passageway whereby a cleaning fluid may be directed through said bore to said interior and thereafter to said first contact and said second contact to clean said contacts.

2. The rotary switch of claim 1, wherein said rotary switch is a potentiometer.

3. A rotary switch comprising:

a housing having a hollow interior;

a shaft rotatable mounted in said housing, said shaft having an exterior surface and defining a bore which extends through a length of said shaft, said bore communicating with an inlet, defined in the exterior surface of said shaft, said bore further communicating with an outlet defined in said exterior surface of said shaft, said inlet being positioned externally of said housing, said outlet being positioned within said interior of said housing, said bore establishing a fluid communication between the environment and said interior;

a first contact connected to said shaft, said first contact being disposed within said interior; and a second contact, disposed within said interior, positioned to contact said second contact;

wherein said bore provides a passageway whereby a cleaning fluid may be directed through said bore to said interior and thereafter to said first contact and said second contact to clean said contacts;

wherein said housing includes an insulating base, said second contact being supported by said insulating base and said shaft passing through said insulating base.

4. A rotary switch comprising:

a housing having a hollow interior;

a shaft rotatable mounted in said housing, said shaft having an exterior surface and defining a bore which extends through a length of said shaft, said bore communicating with an inlet, defined in the exterior surface of said shaft, said bore further communicating with an outlet defined in said exterior surface of said shaft, said inlet being positioned externally of said housing, said outlet being positioned within said interior of said housing, said bore establishing a fluid communication between the environment and said interior;

a first contact connected to said shaft, said first contact being disposed within said interior; and a second contact, disposed within said interior, positioned to contact said second contact;

wherein said bore provides a passageway whereby a cleaning fluid may be directed through said bore to said interior and thereafter to said first contact and said second contact to clean said contacts;

wherein said bore has a first section and a second section, said second section being dimensioned to receive a tube therein, said first section being dimensioned to preclude the entry of said tube therein.

5. The rotary switch of claim 3, further comprising a knob removably secured on said shaft to cover said inlet of said bore.

6. A rotary switch assembly comprising:

a housing defining an interior;

a shaft rotatably mounted in said housing, said shaft having an exterior surface and defining a bore which extends through the body of said shaft along a length of said shaft, said bore communicating with an inlet, defined in the exterior surface of said shaft, said bore further communicating with an outlet defined in said exterior surface of said shaft, said inlet being positioned externally of said housing, said outlet being positioned within said interior of said housing, said bore establishing a fluid communication between the environment and said interior;

a first contact connected to said shaft and disposed within said interior;

a second contact disposed within said interior of said housing to contact said first contact; and a knob detachably secured on said shaft to cover said inlet of said bore;

wherein said bore defines a passageway wherein fluid may be directed through said inlet, through said length of said bore to said outlet and thereafter to said first contact and said second contact.

7. A rotary switch assembly comprising:

a housing defining an interior;

a shaft rotatably mounted in said housing, said shaft having an exterior surface and defining a bore which extends through the body of said shaft along a length of said shaft, said bore communicating with an inlet, defined in the exterior surface of said shaft, said bore further communicating with an outlet defined in said exterior surface of said shaft, said inlet being positioned externally of said housing, said outlet being positioned within said interior of said housing, said bore establishing a fluid communication between the environment and said interior;

a first contact connected to said shaft and disposed within said interior;

a second contact disposed within said interior of said housing to contact said first contact; and a knob detachably secured on said shaft to cover said inlet of said bore;

wherein said bore defines a passageway whereby fluid may be directed through said inlet, through said length of said bore to said outlet and thereafter to said first contact and said second contact;

wherein said contact is supported by an insulating base through which said shaft passes.

8. The rotary switch assembly of claim 7, wherein said housing is a mixer.

9. The rotary switch assembly of claim 7, wherein said housing is a guitar.

10. The rotary switch assembly of claim 7, wherein the rotary switch assembly is a potentiometer.

11. The rotary switch assembly of claim 7, wherein said inlet is defined on a first end of said shaft.

12. The rotary switch assembly of claim 7, wherein said outlet is defined on a second end of said shaft.

13. The rotary switch assembly of claim 7, wherein said inlet is defined on a first end of said shaft and said outlet is defined on a second end of said shaft.

14. A rotary switch assembly comprising:

a housing defining an interior;

a shaft rotatable mounted in said housing, said shaft having an exterior surface and defining a bore which extends through the body of said shaft along a length of said shaft, said bore communicating with an inlet, defined in the exterior surface of said shaft, said bore further communicating with an outlet defined in said exterior surface of said shaft, said inlet being positioned externally of said housing, said outlet being positioned within said interior of said housing, said bore establishing a fluid communication between the environment and said interior;

a first contact connected to said shaft and disposed within said interior;

a second contact disposed within said interior of said housing to contact said first contact; and a knob detachably secured on said shaft to cover said inlet of said bore;

wherein said bore defines a passageway whereby fluid may be directed through said inlet, through said length of said bore to said outlet and thereafter to said first contact and said second contact wherein said bore has a first section and a second section, said second section being dimensioned to receive a tube therein, said first section being dimensioned smaller than said second section to preclude the reception therein of said tube.

15. A kit comprising a rotary switch comprising:

a housing having a hollow interior;

a shaft rotatably mounted in said housing, said shaft having an exterior surface and defining a bore which extends through a length of said shaft, said bore communicating with an inlet, defined in the exterior surface of said shaft, said bore further communicating with an outlet defined in said exterior surface of said shaft, said inlet being positioned externally of said housing, said outlet being positioned within said interior of said housing, said bore establishing a fluid communication between the environment and said interior;

a first contact connected to said shaft, said first contact being disposed within said interior; and a second contact, disposed within said interior, positioned to contact said second contact;

wherein said bore provides a passageway whereby a cleaning fluid may be directed through said bore to said interior and thereafter to said first contact and said second contact to clean said contacts;

a tube dimensioned to be slidably received with said bore; and a source of pressurized cleaning fluid, said tube being adapted for connection to said source of pressurized cleaning fluid.

16. The kit of claim 15, wherein said tube is adapted for detachable connection to said source of pressurized cleaning fluid.

* * * * *